United States Patent [19]

Hartshorn

[11] Patent Number: 4,979,471

[45] Date of Patent: Dec. 25, 1990

[54] ANIMAL CONFINEMENT CHUTE

[76] Inventor: Larry Hartshorn, 36181 Weld County Rd. 15, Windsor, Colo. 80550

[21] Appl. No.: 506,662

[22] Filed: Apr. 9, 1990

[51] Int. Cl.[5] ..... A61D 3/00

[52] U.S. Cl. ..... 119/98

[58] Field of Search ..... 119/98, 99, 27, 155

[56] References Cited

U.S. PATENT DOCUMENTS

| | | | |
|---|---|---|---|
| 2,522,170 | 9/1950 | Fuller | 119/99 |
| 3,220,384 | 11/1965 | Trefz | 119/99 |
| 3,370,825 | 2/1968 | Crowson | 119/98 |
| 3,805,742 | 4/1974 | Shulick et al. | 119/27 |
| 3,828,733 | 8/1974 | Correia | 119/27 X |
| 4,280,448 | 7/1981 | Ostermann | 119/155 |

*Primary Examiner*—Gene Mancene
*Assistant Examiner*—R. Thomas Price
*Attorney, Agent, or Firm*—Dean P. Edmundson

[57] ABSTRACT

An animal confinement chute having first and second spaced-apart, upright side panels, an upright front panel hinged to one side panel and having a length greater than the spacing between side panels, a control lever which is accessible at the rear of the chute, and a locking arm connected between the front panel and the control lever. The front panel, and optionally a side panel, can be opened and closed from the rear of the chute.

16 Claims, 9 Drawing Sheets

ANIMAL CONFINEMENT CHUTE

FIELD OF THE INVENTION

This invention relates to animal confinement apparatus and techniques. More particularly, this invention relates to confinement chutes in which large animals (e.g., bovines and horses) can be temporarily restrained to enable medical treatment or other care of such animals.

BACKGROUND OF THE INVENTION

Large animals such as bovines and equines often must be confined and restrained to enable such animals to be medically examined or treated or artificially inseminated, palpated, etc. Also, when some large animals give birth they require assistance and must be restrained for that purpose.

Conventionally, large animals are confined and restrained in a squeeze chute. This is a narrow chute in which one or both sides can be moved towards the opposite side to squeeze an animal confined therein. Such chutes typically also include a head gate which closes around the neck of the animal to further restrain the animal.

Such conventional chutes require more than one person to operate them efficiently. Also, such chutes are relatively expensive and do require periodic maintenance and repair to keep them in good working order. Further, in order to release an animal from the chute, it is necessary to release the animal from the head gate, move the side panels away from each other, and open the front end of the chute enough to allow the animal to walk out the front of the chute. These steps normally require more than one person.

Thus, conventional chutes are inefficient and cumbersome for one person to work an animal. This is particularly true when working an animal from the rear.

There has not heretofore been provided an animal confinement chute of the type described herein which is effective and which is operable by one person.

SUMMARY OF THE PRESENT INVENTION

In accordance with the present invention there is provided an animal confinement chute which is particularly suited for large animals (e.g., bovines and equines) and which is operable by one person. The confinement chute comprises:

(a) first and second spaced-apart, upright side panels each having forward and rearward ends;

(b) an upright front panel having first and second ends; wherein the first end is pivotally attached to the first panel; wherein the front panel has a length greater than the spacing between the side panels; wherein the front panel is pivotable between closed and open positions;

(c) a control lever having first and second ends; wherein the first end is accessible at the rearward end of the chute; and (d) a locking arm having first and second ends; wherein the first end is pivotally attached to the front panel and the second end is pivotally attached to the second end of the control lever; the locking arm being movable between a locking position and an open position.

The control lever is adapted to move the locking arm between the locking and open positions and is further adapted to move the front panel between its closed and open positions. Thus, one person standing at the rearward end of the chute is able to open and close the front panel easily and effectively from such remote position.

Because the front panel has a length greater than the spacing between the side panels, when the front panel is in its closed position it is angled with respect to the side panels. This results in a narrowing of the width of the chute at the forward end. When an animal walks into the chute its head goes into the narrowed area. This effectively restrains and immobilizes the animal without having to squeeze inwardly with the side panels and without having to clamp the neck of the animal in a conventional headgate.

Optionally the chute may include a floor member extending between the two side panels. It is also possible to have one of the side members be pivotally attached at its rearward end to enable it to swing outwardly to allow a side exit for an animal in the chute. Preferably the side panel can be released from a position behind the chute.

Other advantages of the animal confinement chute of the invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
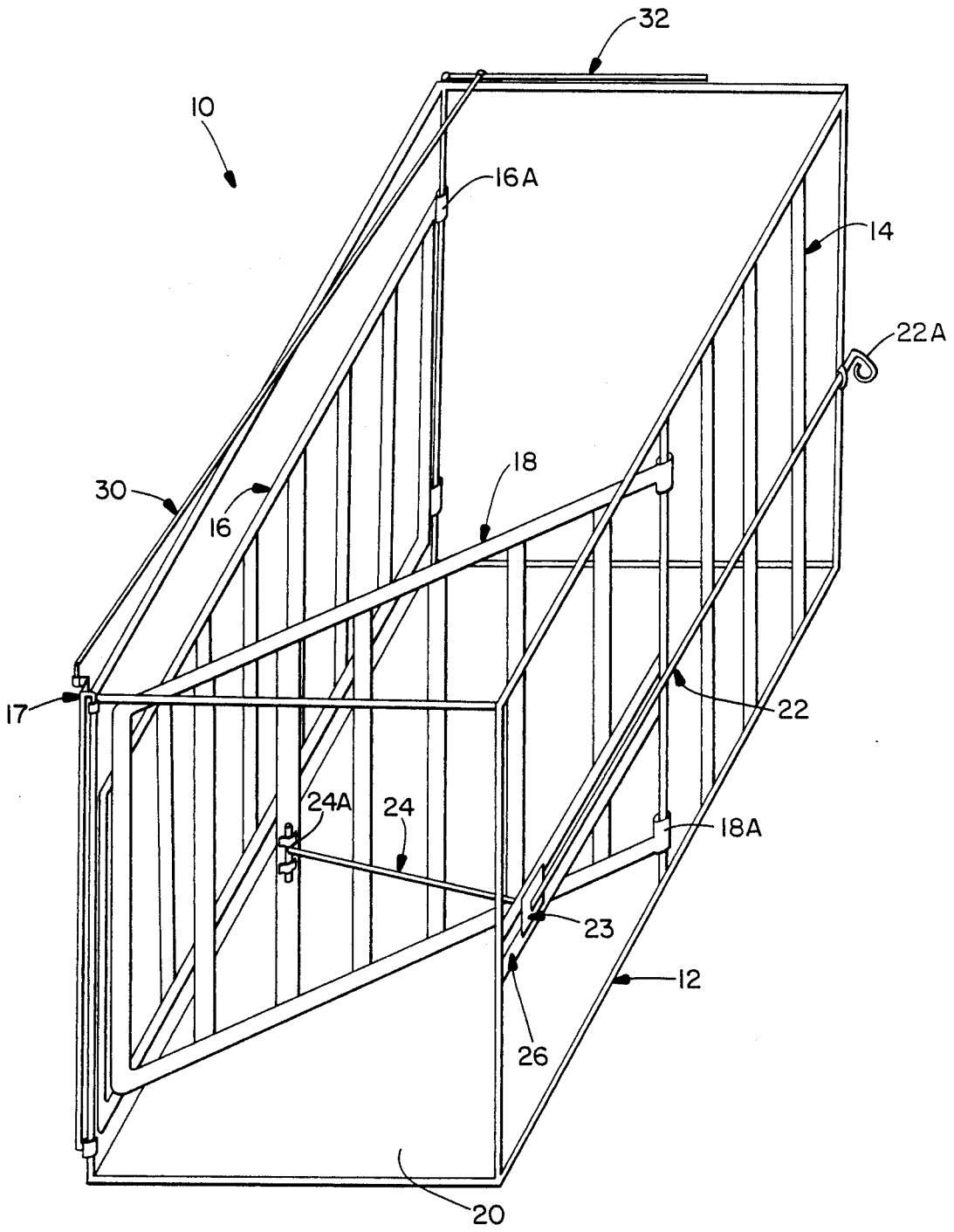
FIG. 1 is a perspective view of a preferred embodiment of animal confinement chute of the invention.

In the drawings there is illustrated an animal confinement chute 10 of the invention having a rectangular frame 12, opposing spaced-apart side panels 14 and 16, and front panel 18. A horizontal floor member 20 extends between the two sides of the chute 10 and is connected to the frame member 12 on each side.

The front panel 18 is pivotally attached or mounted at one end 18A to side panel 14. Alternatively, the front panel 18 could be pivotally attached to the frame 12. Because the length of the front panel is greater than the spacing between the two side panels, the front panel forms an acute angle with respect to the side panel 16, as shown. Preferably this angle is in the range of about 25° to 55°.

The spacing between the two side panels is preferably in the range of about 24 to 36 inches. The length of the chute is preferably in the range of about 7 to 9 feet. Preferably the length of the front panel is in the range of about 3.5 to 5 feet. The height of the chute is preferably in the range of about 60 to 80 inches.

An elongated control lever 22 extends along one side of the chute and is longitudinally slidable between forward and rearward positions. Handle 22A is accessible at the rear of the chute to enable a person to operate the control lever from the rearward end of the chute.

Figure 2:
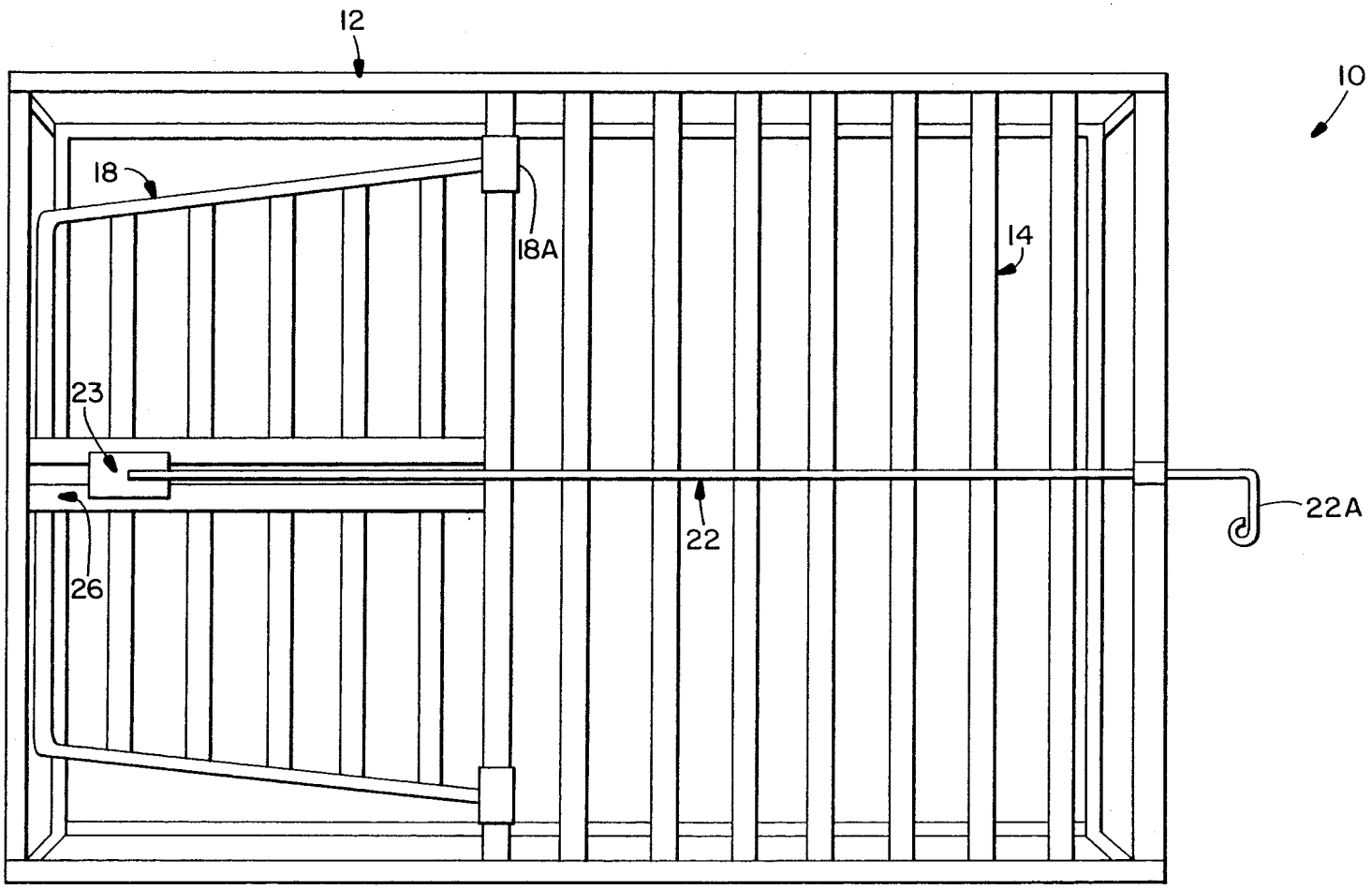
FIG. 2 is a side elevational view of the chute shown in FIG. 1.
Figure 3:
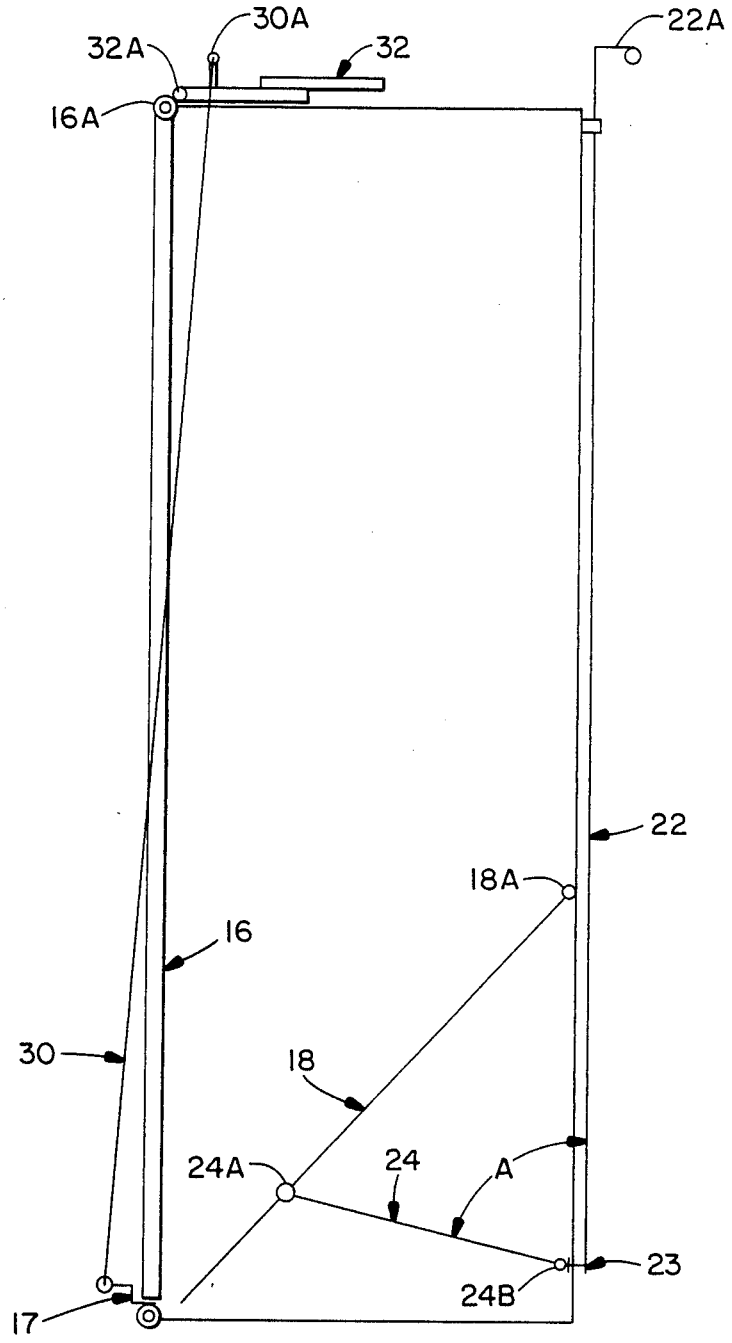
FIGS. 3–7 are top schematic views of an animal confinement chute of the invention illustrating the operation of the chute.
Figure 5:
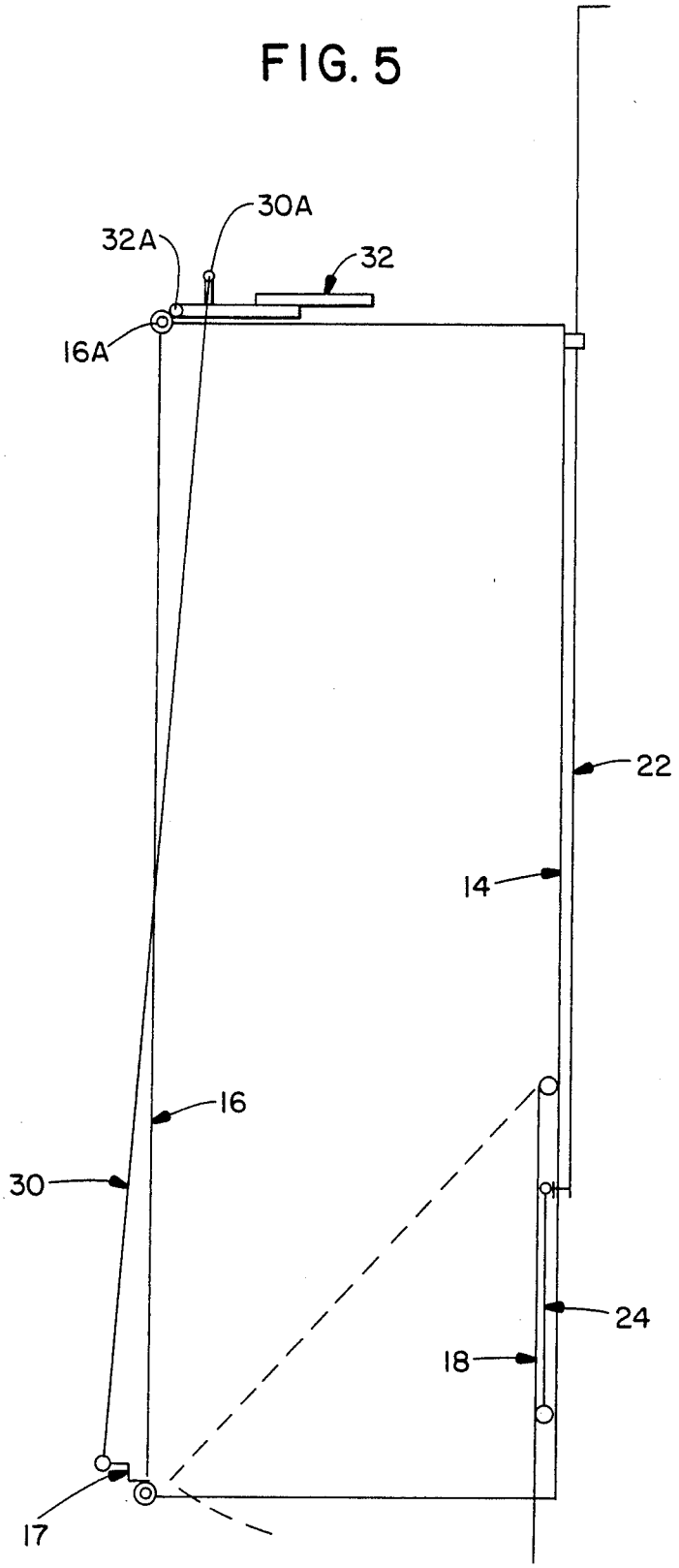

The forward end of the control lever 22 is attached to a slide member 23 carried in track 26. Pivotally attached to slide member 23 is end 24B of locking arm 24. End 24A is pivotally attached to front panel 18, as illustrated. When control lever 22 is moved to its rearward position it moves slider 23 rearwardly along track 26. This causes front panel 18 to pivot from its closed position (FIGS. 1, 2, 3) to its open position (FIG. 5).

When control lever 22 is in its forward position, locking arm 24 holds front panel 18 in its closed position. Because locking arm 24 forms an angle A of less than 90° with respect to control lever 22 when the control lever is in its forward position, the locking arm prevents opening of the front panel 18 by pressure exerted against it by an animal in the chute. Yet, by simple movement of the control lever to its rearward position, the front panel is moved to its open position to release the animal.

Figure 4:
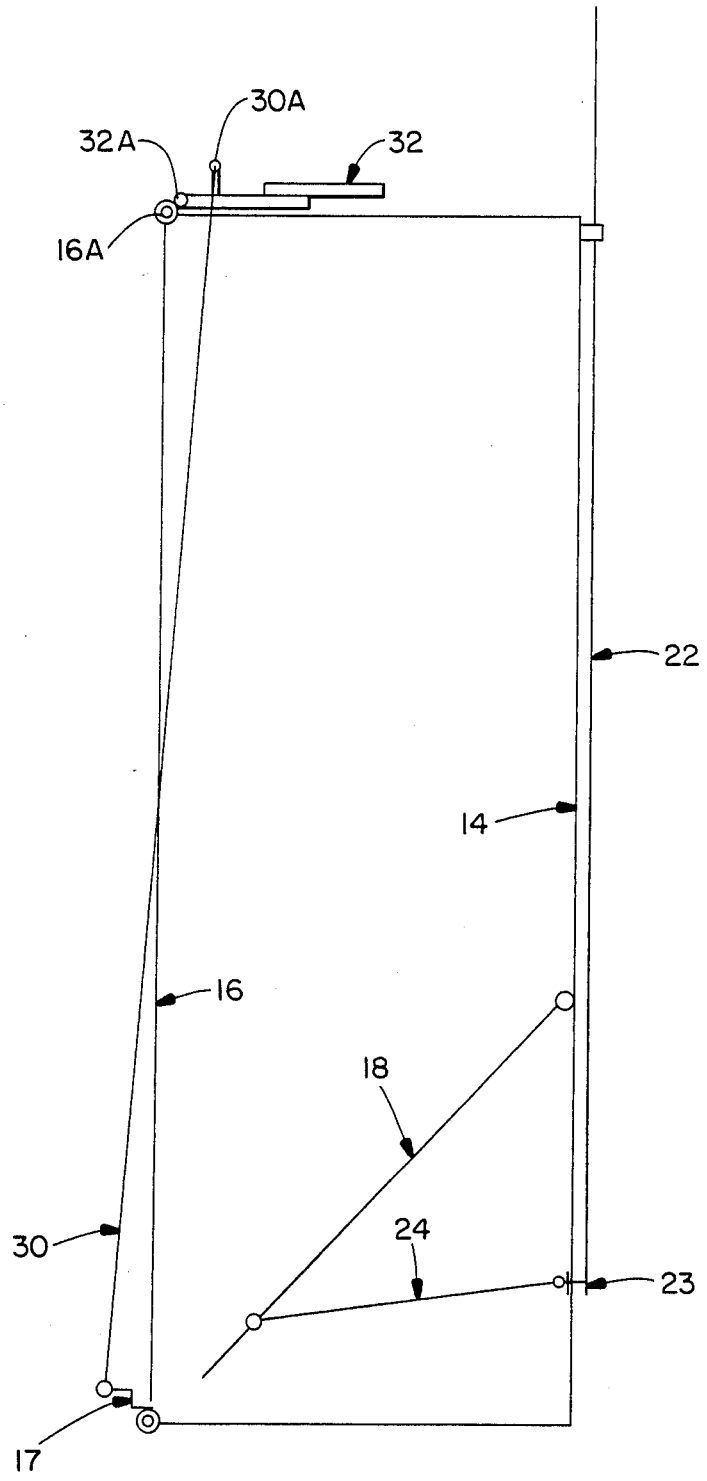

FIG. 4 is a top view illustrating the initial movement of the control lever 22 in a rearward direction. After it is moved a short distance rearwardly, the angle between the locking arm 24 and the control lever exceeds 90° and the front panel 18 begins to move toward its open position. When the control lever is moved to its full rearward position, as shown in FIG. 5, the front panel 18 is moved to a fully-open position where it is parallel to side panel 14. The dotted lines show the closed position of front panel 18 and its path during opening to release the animal from the chute.

Thus, an animal enters the chute through the open rearward end. The animal's head moves into the V-shaped front portion of the chute and is thereby confined and restrained. Optionally, a horizontal stay member may be placed across the chute at the rearward end to prevent the animal from backing out of the chute, although it has been found that most animals will stand in the chute and will be effectively immobilized by the narrowed front portion of the chute.

Because the front panel 18 can be easily opened and closed from the rear of the chute by means of the control lever 22, this increases the speed and efficiency with which animals can be put through the chute for medical treatment or pregnancy check, etc. and it reduces the number of workmen and the attendant labor cost.

Another significant preferred feature of the chute of the invention is that side panel 16 can be pivotally attached at its rearward end 16A to the frame 12. At the forward end of the chute there is pivotally mounted a retention member 17 which is movable between open and closed positions. When retention member 17 is in its closed position it prevents side panel 16 from opening. When retention member 17 is in its open position, side panel 16 may pivot about its rearward end to allow an animal to exit the chute through the side. This can be an important feature, for example, when sorting animals, or when an animal lays down in the chute and won't get up.

The retention member 17 can be moved between its open and closed positions by means of elongated rod or release arm 30 extending to the rearward end of the chute where one end 30A is pivotally attached to release lever 32. One end 32A of release lever 32 is pivotally attached to the frame. When the release lever 32 is moved to a release position the side panel 16 can be pivoted to its open position.

Figure 6:
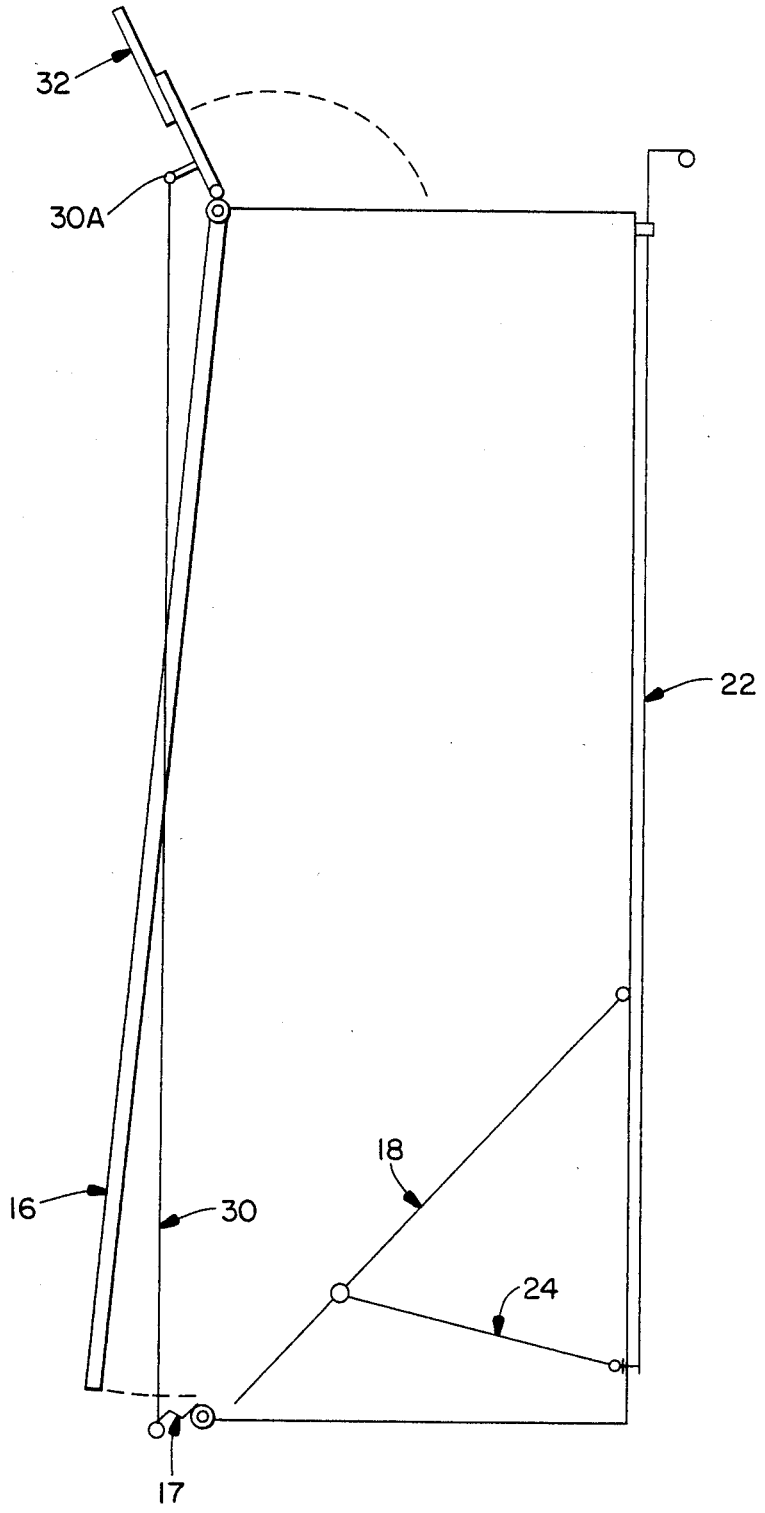
Figure 7:
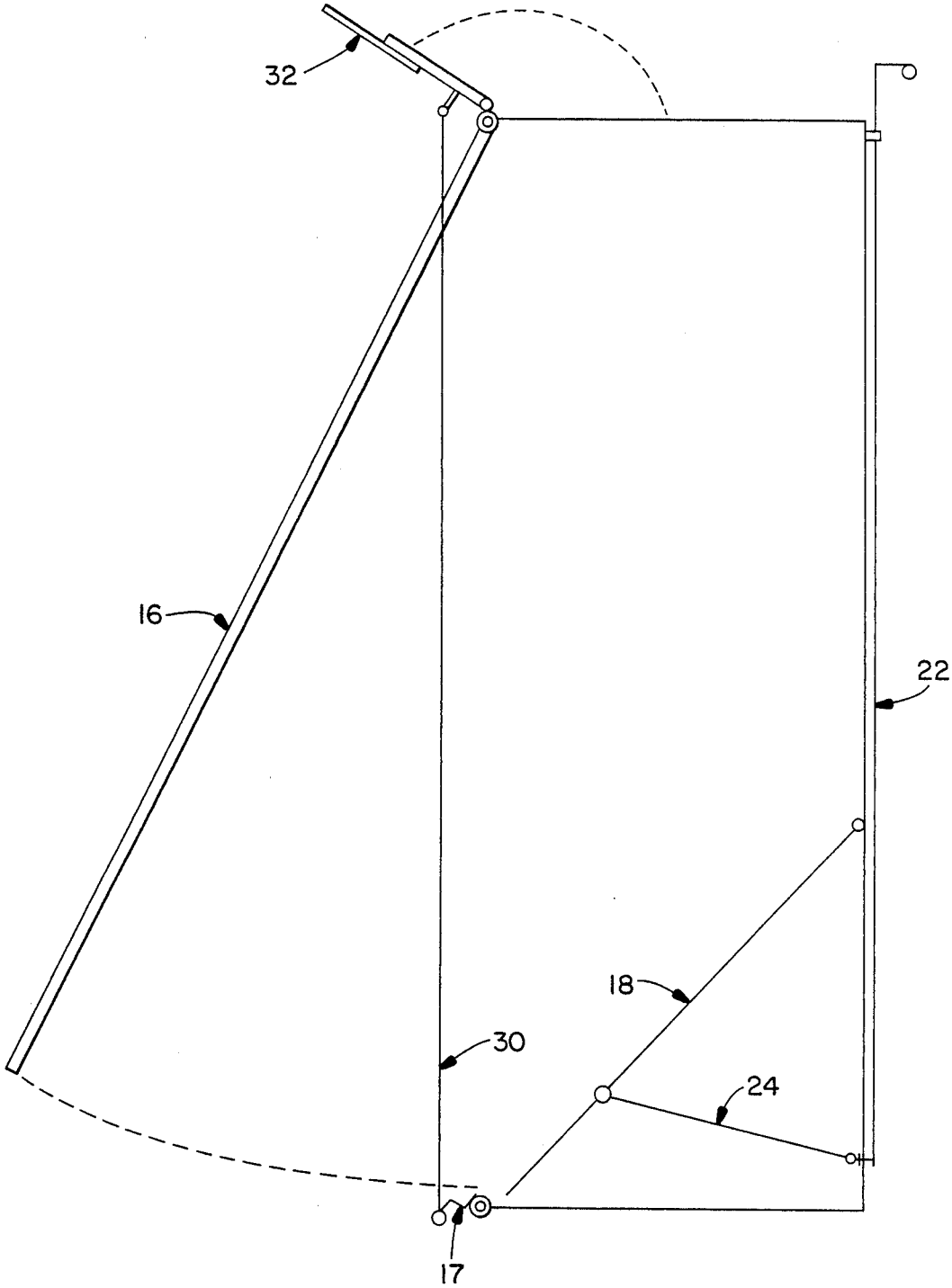

This is illustrated in FIGS. 6 and 7 where release lever 32 is moved to a release position to cause the retention member 17 to rotate or pivot to its open position. This allows the forward end of side panel 16 to swing outwardly, as illustrated.

Figure 8:
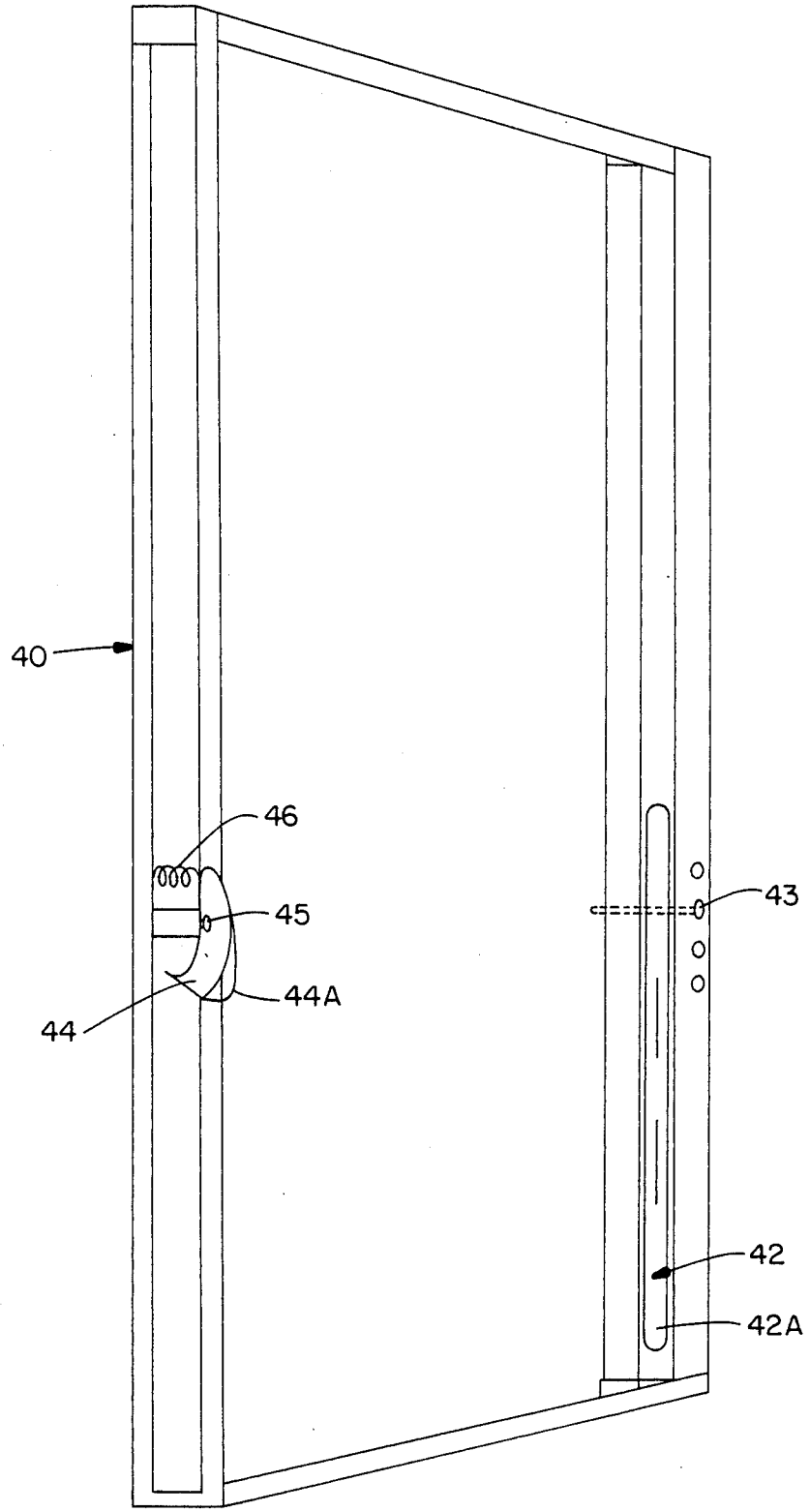
FIGS. 8 and 9 illustrate two types of optional rear restraints which are useful in the confinement chutes of the invention.

One type of rear restraint member is illustrated in FIG. 8. This figure shows rear frame member 40 in which a stay or restraining bar 42 is pivotally attached by pin 43. In this figure the bar 42 is shown in its downward position. After an animal has entered the chute, the bar 42 may be pivoted upwardly. When the bar is in a horizontal position the end 42A of the bar is captured by lock 44 (which is pivoted on pin 45 and is biased to a lock position by spring 46). When the bar 42 is in its horizontal position it prevents the animal from backing out of the chute. To release bar 42 from its upward position the handle 44A is pulled rearwardly to release bar 42 from the lock 44.

Figure 9:
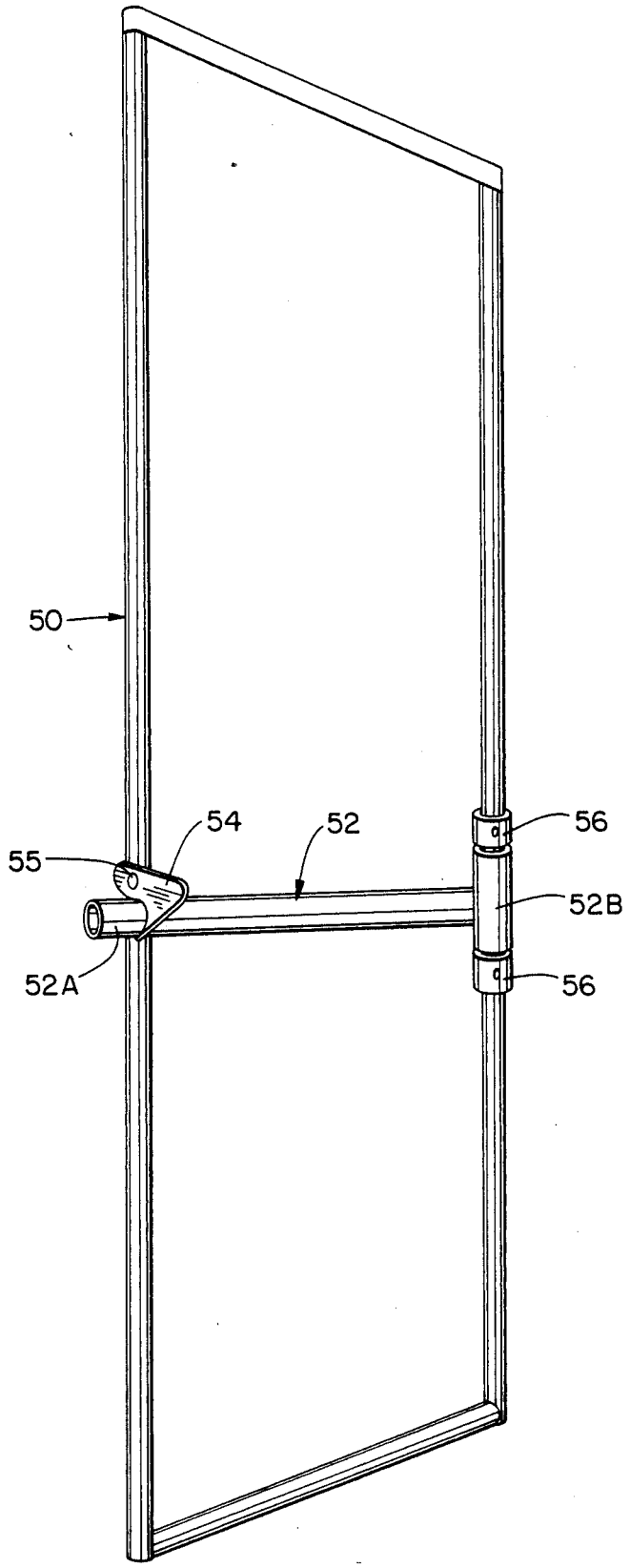

Another embodiment of rear restraining bar is illustrated in FIG. 9. In this embodiment the bar 52 is pivoted at end 52B to rear frame 50. Sleeves 56 are secured to the frame above and below end 52B to stabilize bar 52 vertically. Catch member 54, pivoted on pin 55, serves to retain end 52A of bar 52 in the position shown in the drawing. To release bar 52 the catch member 54 is pivoted upwardly. Then the bar 52 can be pivoted rearwardly to allow another animal to enter the chute.

Other variations are possible for a rear restraint bar. For example, there may be more than one of such bars. They can be pivoted so as to move between raised and lowered positions, as desired.

Other variants are possible without departing from the scope of this invention.

What is claimed is:

1. An animal confinement chute having forward and rearward ends, said chute comprising:

(a) first and second spaced-apart, upright side panels each having forward and rearward ends;

(b) an upright front panel having first and second ends, wherein said first end is pivotally attached to said first panel; wherein said front panel has a length greater than the spacing between said side panels; wherein said front panel is pivotable between closed and open positions;

(c) a control lever having first and second ends; wherein said first end is accessible at said rearward end of said chute;

(d) a locking arm having first and second ends; wherein said first end is pivotally attached to said front panel and said second end is pivotally attached to said second end of said control lever; said locking arm being movable between a locking position and an open position;

wherein said control lever is adapted to move said locking arm between said locking and open positions and is further adapted to move said front panel between its closed and open positions.

2. A chute in accordance with claim 1, wherein said first and second panels are parallel.

3. A chute in accordance with claim 1, wherein said second end of said front panel is disposed forwardly of said first end of said front panel when said front panel is in said closed position; and wherein said second end of said front panel is adjacent said forward end of said second side panel when said front panel is in said closed position.

4. A chute in accordance with claim 1, wherein said control lever is carried by said first side panel and is slidingly movable between forward and rearward positions.

5. A chute in accordance with claim 1, further comprising a horizontal floor member extending between said side panels.

6. A chute in accordance with claim 4, wherein said locking arm forms an angle less than 90° with said control lever when said control lever is in said forward position.

7. A chute in accordance with claim 1, wherein said second side panel is pivotally supported at said rearward end.

8. A chute in accordance with claim 1, wherein said front panel forms an angle in the range of about 25° to 55° with said second side panel when said front panel is in said closed position.

9. An animal confinement chute having forward and rearward ends, said chute comprising:

(a) first and second spaced-apart, upright side panels each having forward and rearward ends; wherein said side panels are supported by a frame member;

(b) an upright front panel having first and second ends, wherein said first end is pivotally attached to said first panel; wherein said front panel has a length greater than the spacing between said side panels; wherein said front panel is pivotable between closed and open positions;

(c) a control lever having first and second ends; wherein said first end is accessible at said rearward end of said chute; wherein said control lever is carried by said first side panel and is slidingly movable between forward and rearward positions;

(d) a locking arm having first and second ends; wherein said first end is pivotally attached to said front panel and said second end is pivotally attached to said second end of said control lever; said locking arm being movable between a locking position and an open position;

wherein said control lever is adapted to move said locking arm between said locking and open positions and is further adapted to move said front panel between its closed and open positions.

10. A chute in accordance with claim 9, wherein said first and second panels are parallel.

11. A chute in accordance with claim 9, wherein said second end of said front panel is disposed forwardly of said first end of said front panel when said front panel is in said closed position; and wherein said second end of said front panel is adjacent said forward end of said second side panel when said front panel is in said closed position.

12. A chute in accordance with claim 9, further comprising a horizontal floor member extending between said side panels.

13. A chute in accordance with claim 9, wherein said locking arm forms an angle less than 90° with said control lever when said control lever is in said forward position.

14. A chute in accordance with claim 9, wherein said second side panel is pivotally supported at said rearward end.

15. A chute in accordance with claim 9, wherein said front panel forms an angle in the range of about 25° to 55° with said second side panel when said front panel is in said closed position.

16. A chute in accordance with claim 14, further comprising a release arm extending from said rearward end of said chute to said forward end thereof; wherein said release arm is adapted to releasably secure said forward end of said second side panel in a closed position.

* * * * *